US010663188B2

(12) United States Patent
Shaffer

(10) Patent No.: US 10,663,188 B2
(45) Date of Patent: May 26, 2020

(54) METHOD FOR OPERATING A PACKAGED TERMINAL AIR CONDITIONER

(71) Applicant: Haier US Appliance Solutions, Inc., Wilmington, DE (US)

(72) Inventor: Timothy Scott Shaffer, LaGrange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 21 days.

(21) Appl. No.: 15/860,726

(22) Filed: Jan. 3, 2018

(65) Prior Publication Data

US 2019/0203970 A1 Jul. 4, 2019

(51) Int. Cl.

| | |
|---|---|
| ***F24F 11/755*** | (2018.01) |
| ***F24F 7/013*** | (2006.01) |
| ***F24F 1/027*** | (2019.01) |
| *F24F 110/32* | (2018.01) |

(52) U.S. Cl.

CPC ..... *F24F 11/755* (2018.01); *F24F 1/027* (2013.01); *F24F 7/013* (2013.01); *F24F 2110/32* (2018.01)

(58) Field of Classification Search

CPC ..... F24F 11/755; F24F 1/027; F24F 7/013; F24F 2110/32

USPC ..... 62/89

See application file for complete search history.

(56) References Cited

U.S. PATENT DOCUMENTS

| | | | | |
|---|---|---|---|---|
| 6,594,554 | B1 | 7/2003 | Seem et al. | |
| 2005/0115258 | A1* | 6/2005 | Violand | F24F 1/027 62/186 |
| 2010/0000239 | A1* | 1/2010 | Lifson | F25B 13/00 62/89 |
| 2011/0016893 | A1* | 1/2011 | Dawes | F25B 49/02 62/89 |

FOREIGN PATENT DOCUMENTS

| | | | |
|---|---|---|---|
| EP | 3059515 | A1 | 8/2016 |
| WO | WO2014126046 | A1 | 8/2014 |

* cited by examiner

*Primary Examiner* — Steve S Tanenbaum
(74) *Attorney, Agent, or Firm* — Dority & Manning, P.A.

(57) ABSTRACT

A method for operating a packaged terminal air conditioner includes activating a compressor of the packaged terminal air conditioner such that refrigerant flows through an interior coil of the packaged terminal air conditioner, and, while the compressor is active, periodically cycling a fan of the packaged terminal air conditioner between a low speed active operating state and an inactive operating state. The fan runs at a modulated speed limit of the fan in the low speed active operating state, and the fan is unpowered in the inactive operating state.

14 Claims, 2 Drawing Sheets

METHOD FOR OPERATING A PACKAGED TERMINAL AIR CONDITIONER

FIELD OF THE INVENTION

The present subject matter relates generally to packaged terminal air conditioner units.

BACKGROUND OF THE INVENTION

Packaged terminal air conditioner units generally include a casing and a sealed system within the casing. The sealed system includes components for chilling and/or heating air with refrigerant. In particular, a compressor of the sealed system operates to increase a pressure of the refrigerant. A speed of the compressor is generally variable to provide suitable efficiency and comfortable outlet air temperatures. However, constraints on sealed system components can limit the ability of the sealed system to operate efficiently at lower compressor speeds.

Accordingly, a packaged terminal air conditioner unit with features for facilitating efficient operation at low compressor speeds would be useful.

BRIEF DESCRIPTION OF THE INVENTION

The present subject matter provides a method for operating a packaged terminal air conditioner is provided. The method includes activating a compressor of the packaged terminal air conditioner such that refrigerant flows through an interior coil of the packaged terminal air conditioner, and, while the compressor is active, periodically cycling a fan of the packaged terminal air conditioner between a low speed active operating state and an inactive operating state. The fan runs at a modulated speed limit of the fan in the low speed active operating state, and the fan does not urge air through the interior coil in the inactive operating state. Additional aspects and advantages of the invention will be set forth in part in the following description, or may be apparent from the description, or may be learned through practice of the invention.

In a first example embodiment, a method for operating a packaged terminal air conditioner is provided. The method includes activating a compressor of the packaged terminal air conditioner such that refrigerant flows through an interior coil of the packaged terminal air conditioner, and, while the compressor is active, periodically cycling a fan of the packaged terminal air conditioner between a low speed active operating state and an inactive operating state. The fan runs at a modulated speed limit of the fan in the low speed active operating state, and the fan does not urge air through the interior coil in the inactive operating state. A total time that the fan is in the low speed active operating state during said step of periodically cycling the fan corresponds to a capacity of the compressor.

In a second example embodiment, a method for operating a packaged terminal air conditioner is provided. The method includes activating a compressor of the packaged terminal air conditioner such that refrigerant flows through an interior coil of the packaged terminal air conditioner, and, while the compressor is active, cycling a fan of the packaged terminal air conditioner between a low speed active operating state and an inactive operating state according to the following $$X+Y=60 \text{ seconds}$$

where

X is a period of time during which the fan is in the low speed active operating state, Y is a period of time during which the fan is in inactive operating state, and X/60=an effective lower speed of the fan/a modulated speed limit of the fan.

The fan runs at the modulated speed limit of the fan in the low speed active operating state, and the fan is unpowered in the inactive operating state.

In a third example embodiment, a packaged terminal air conditioner is provided. The packaged terminal air conditioner includes a casing. A compressor is positioned within the casing. The compressor is operable to increase a pressure of a refrigerant. An interior coil is positioned within the casing, and a fan is positioned within the casing adjacent the interior coil. An exterior coil is positioned within the casing opposite the interior coil. A controller is in operative communication with the compressor and the fan. The controller is configured to activate a compressor of the packaged terminal air conditioner such that refrigerant flows through the interior coil, and, while the compressor is active, periodically cycle the fan between a low speed active operating state and an inactive operating state. The fan runs at a modulated speed limit of the fan in the low speed active operating state, and the fan does not urge air through the interior coil in the inactive operating state. A total time that the fan is in the low speed active operating state corresponds to a capacity of the compressor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
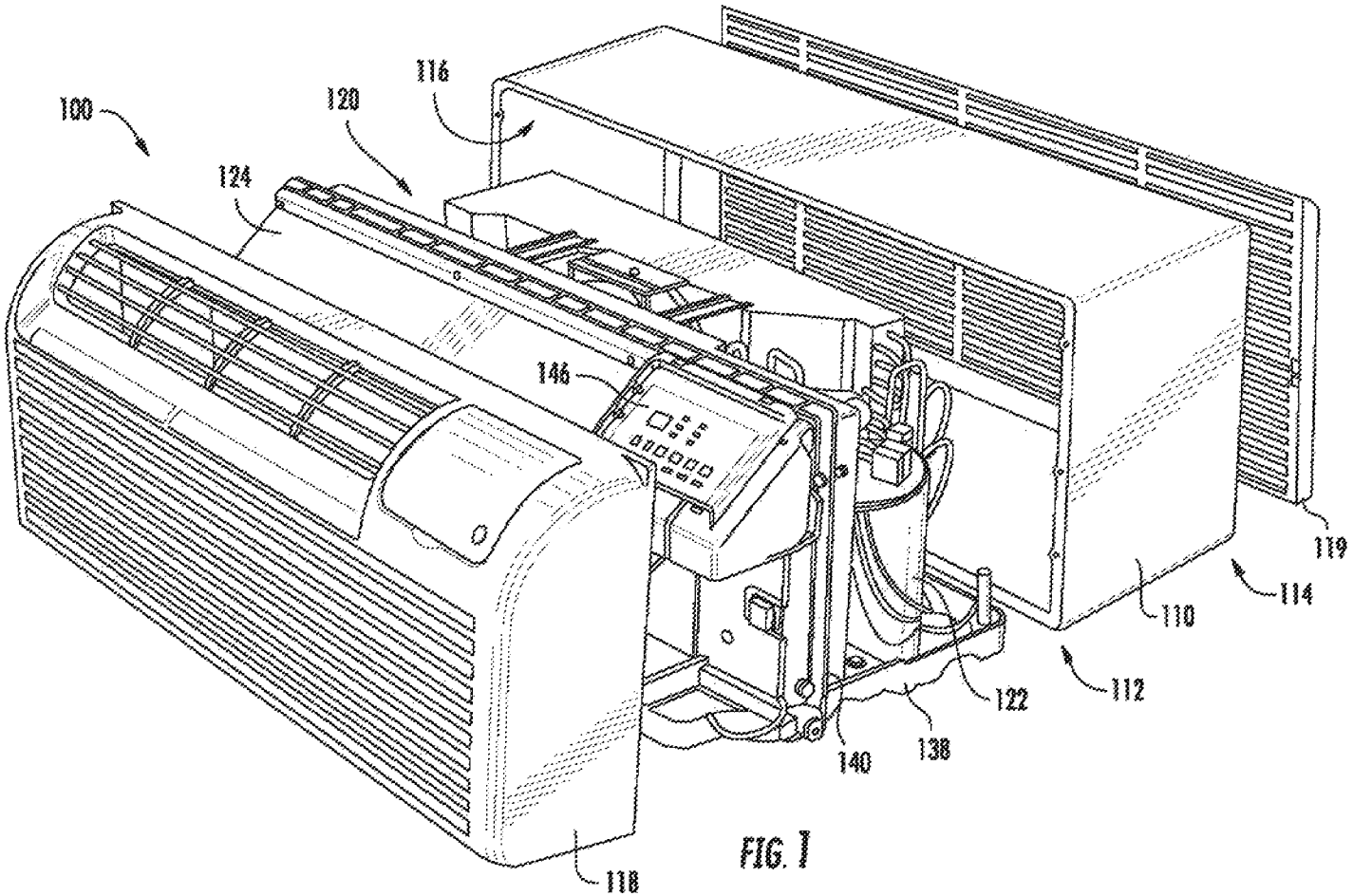
FIG. 1 provides an exploded perspective view of a packaged terminal air conditioner unit according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an example embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 are mounted to casing 110 and hinder or limit access to mechanical compartment 116 of casing 110. Front panel 118 is mounted to casing 110 at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall 140 positioned within mechanical compartment 116 of casing 110. Sealed system 120 is positioned on bottom tray 138. Thus, liquid runoff from sealed system 120 may flow into and collect within bottom tray 138. Inner wall 140 may be mounted to bottom tray 138 and extend upwardly from bottom tray 138 to a top wall of casing 110. Inner wall 140 limits or prevents air flow between interior side portion 112 of casing 110 and exterior side portion 114 of casing 110 within mechanical compartment 116 of casing 110. Thus, inner wall 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
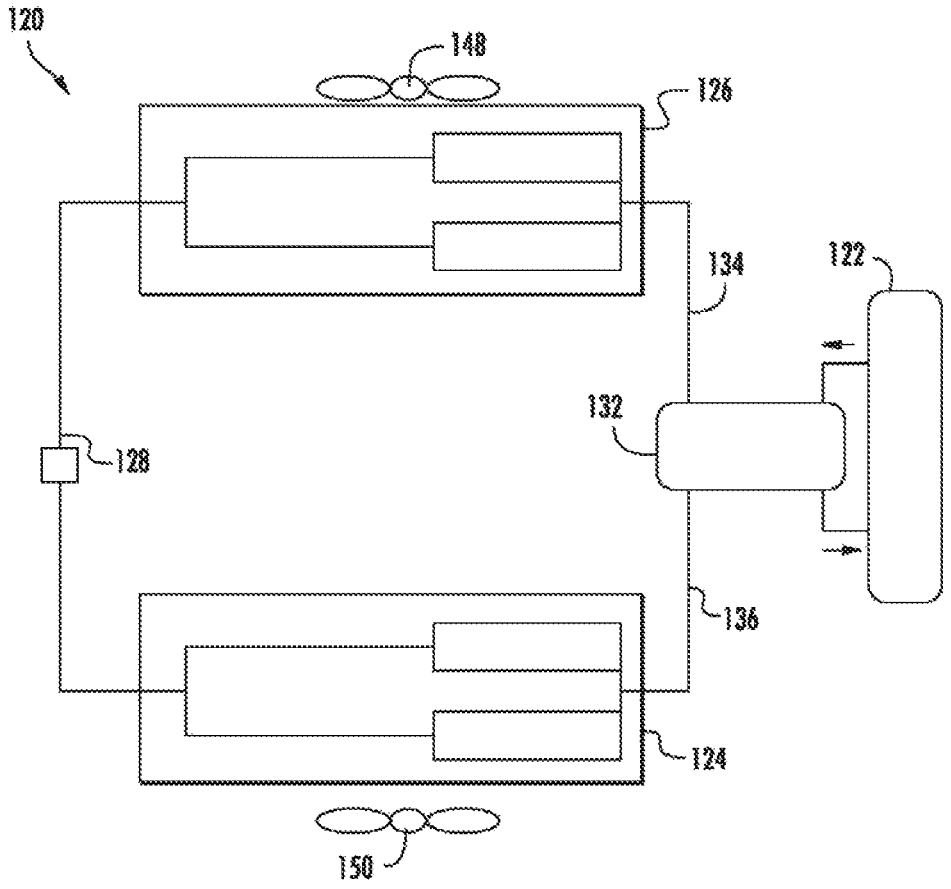
FIG. 2 provides a schematic view of certain components of the example packaged terminal air conditioner unit of FIG. 1.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 also includes a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer.

Sealed system 120 also includes an expansion device 128, such as an electronic expansion valve, disposed between interior coil 124 and exterior coil 126, e.g., on a tube that extends between and fluidly couples interior coil 124 and exterior coil 126. Refrigerant, which may be in the form of high liquid quality/saturated liquid vapor mixture, may exit exterior coil 126 and travel through expansion device 128 before flowing through interior coil 124. Expansion device 128 may generally expand the refrigerant, lowering the pressure and temperature thereof. The refrigerant may then be flowed through interior coil 124.

Interior coil 124 is disposed downstream of expansion device 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from expansion device 128 may enter interior coil 124 via a second distribution conduit 136 that extends between and fluidly connects interior coil 124 and reversing valve 132. Within interior coil 124, the refrigerant from expansion device 128 receives energy from the interior atmosphere and vaporizes into superheated vapor and/or high quality vapor mixture. An interior air handler or fan 150 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of expansion device 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative example embodiments, sealed system 120 may include any suitable components for heating and/or cooling air with a refrigerant. Similarly, sealed system 120 may have any suitable arrangement or configuration of components for heating and/or cooling air with a refrigerant in alternative example embodiments.

Compressor 122 may operate at various speeds in order to adjust the capacity of compressor 122. Thus, e.g., compressor 122 may have a higher capacity when operating at high speeds, and compressor 122 may have a lower capacity when operating at low speeds. Sealed system 120 includes features for operating efficiently when compressor 122 is at a low speed.

Figure 3:
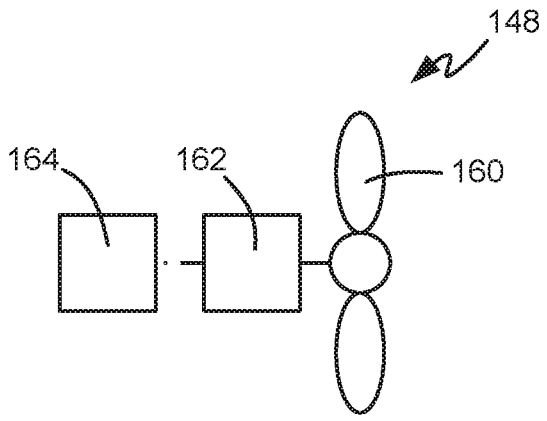
FIG. 3 is a schematic view of an interior fan of the example packaged terminal air conditioner unit of FIG. 1.

As discussed above, interior fan 150 is positioned adjacent interior coil 124 and may facilitate or urge a flow of air from the interior atmosphere across interior coil 124. In certain example embodiments, interior fan 150 may have a modulated speed limit, and interior fan 150 may be inoperable at speeds below the modulated speed limit. In particular, as shown in FIG. 3, interior fan 150 may include a plurality of blades 160, a direct current (DC) motor 162, and a pulse-width modulation circuit 164. Direct current motor 162 is operable to rotate blades 160 when pulse-width modulation circuit 164 powers direct current motor 162. By varying the pulse-width modulation provided by pulse-width modulation circuit 164, direct current motor 162 may rotate blades 160 at various speeds. However, pulse-width modulation circuit 164 does not provide enough torque to rotate blades 160 with direct current motor 162 at speeds below the modulated speed limit. Thus, interior fan 150 may be inoperable to continuously rotate blades 160 at speeds below the modulated speed limit. In certain example embodiments, the modulated speed limit may be about six hundred rotations per minute (600 RPM). As used herein, the term "about" means within ten percent of the stated speed when used in the context of speeds. It will be understood that the six hundred rotations per minute modulated speed limit described above is present in certain commercially available PWC controlled DC fans used in packaged terminal air conditioner units. However, other fans may have other modulated speed limits.

To operate efficiently, the speed of interior fan 150 is generally proportional to the capacity of compressor 122. Thus, sealed system 120 includes features for simulating effective lower speeds for interior fan 150 to overcome the modulated speed limit of interior fan 150, and allow compressor 122 to operate a lower speeds than the compressor speed that is proportional to the modulated speed limit of interior fan 150. Thus, the speed and/or capacity of compressor 122 may be reduced relative to compressors in known sealed systems thereby allowing sealed system 120 to operate more efficiently than the known sealed systems.

A method for operating packaged terminal air conditioner 100 to account for the modulated speed limit of interior fan 150 includes activating compressor 122. For example, controller 146 may turn on or activate compressor 122. As described above, refrigerant flows through interior coil 124 when compressor 122 is active. Thus, compressor 122 may urge the refrigerant through interior coil 124 when compressor 122 is active. While compressor 122 is active, interior fan 150 operates to flow air across interior coil 124. Accordingly, interior fan 150 may facilitate heat exchange between air around interior coil 124 and the refrigerant within interior coil 124 during operation of compressor 122.

Controller 146 may operate interior fan 150 in a manner that provides a suitable effective fan speed and that accounts for the modulated speed limit of interior fan 150. In particular, controller 146 may periodically cycle interior fan 150 between a low speed active operating state and an inactive operating state. Interior fan 150 runs at the modulated speed limit in the low speed active operating state, and interior fan 150 is unpowered and/or does not urge air through interior coil 124 in the inactive operating state. Thus, an angular velocity of blades 160 may be zero for at least a portion of when interior fan 150 is in the inactive operating state.

Pulse-width modulation circuit 164 may power direct current motor 162 to spin blades 160 at the modulated speed limit in the low speed active operating state of interior fan 150. Conversely, pulse-width modulation circuit 164 does not power direct current motor 162 to spin blades 160 in the inactive operating state of interior fan 150. As may be seen from the above, controller 146 may regulate operation of pulse-width modulation circuit 164 to selectively power direct current motor 162 and cycle interior fan 150 between the low speed active operating state and the inactive operating state and thereby provide the suitable effective fan speed.

The period during which controller 146 cycles interior fan 150 between the low speed active operating state and the inactive operating state may be about one minute. Thus, controller 146 may cycle interior fan 150 between the low speed active operating state and the inactive operating state during one minute periods while compressor 122 is active. In particular, controller 146 may cycle interior fan 150 according to the following $$X+Y=\text{sixty (60) seconds}$$

where

X is a period of time during the sixty seconds in which interior fan 150 is in the low speed active operating state, Y is a period of time during the sixty seconds in which interior fan 150 is in inactive operating state, and X/60=an effective lower speed of the fan/the modulated speed limit.

Since sealed system 120 reacts slowly to air flow changes, the above described method cycles interior fan 150 in order to adjust air flow over interior coil 124 without reworking interior fan 150. In particular, interior fan 150 may be cycled in roughly one minute cycles from off to the modulated speed limit for a period of X time and then off again for a period of Y time.

This cycling between the modulated speed limit and off allows sealed system 120 to be balanced at lower compressor speeds. Cycling between the modulated speed limit and off when the compressor is already running also makes the speed changes in interior fan 150 inaudible to a room resident. In combination with expansion device 128, the effective fan speed provided by cycling interior fan 150 enables packaged terminal air conditioner 100 to control the temperature of indoor coil 126 and outlet air temperatures at lower compressor speeds than in known sealed systems.

A total time that interior fan 150 is in the low speed active operating state while controller 146 periodically cycles interior fan 150 may be selected to corresponds to a capacity of compressor 122. Thus, lower capacity sealed system control at optimized heat exchangers enables packaged terminal air conditioner 100 to run at better efficiencies when room conditions warrant. Use of cycling from the modulated speed limit to off to the modulated speed limit to simulate effective lower fan speeds allows matching performance without re-engineering the air flow system or physically modifying interior fan 150.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a packaged terminal air conditioner, the method comprising:

activating a compressor of the packaged terminal air conditioner such that refrigerant flows through an interior coil of the packaged terminal air conditioner; and while the compressor is active, periodically cycling a fan of the packaged terminal air conditioner between a low speed active operating state and an inactive operating state, wherein the fan runs at a modulated speed limit of the fan in the low speed active operating state, and the fan does not urge air through the interior coil in the inactive operating state, wherein a total time that the fan is in the low speed active operating state during said step of periodically cycling the fan corresponds to a capacity of the compressor, wherein the fan is inoperable at speeds below the modulated speed limit, and wherein an angular velocity of a plurality of blades of the fan is zero for at least a portion of when the fan is in the inactive operating state.

2. The method of claim 1, wherein the fan comprises a direct current motor and a pulse-width modulation circuit, the direct current motor operable to rotate the plurality of blades when the pulse-width modulation circuit powers the direct current motor.

3. The method of claim 2, wherein the fan is inoperable at speeds below the modulated speed limit because the pulse-width modulation circuit does not provide enough torque to rotate the plurality of blades with the direct current motor.

4. The method of claim 3, wherein the modulated speed limit of the fan is about six hundred rotations per minute.

5. The method of claim 1, wherein said step of periodically cycling the fan comprises cycling the fan between the low speed active operating state and the inactive operating state during one minute periods while the compressor is active.

6. A method for operating a packaged terminal air conditioner, the method comprising:

activating a compressor of the packaged terminal air conditioner such that refrigerant flows through an interior coil of the packaged terminal air conditioner; and while the compressor is active, cycling a fan of the packaged terminal air conditioner between a low speed active operating state and an inactive operating state according to the following:

$$X+Y=60 \text{ seconds}$$

where

X is a period of time during which the fan is in the low speed active operating state, Y is a period of time during which the fan is in inactive operating state, and wherein the fan runs at the modulated speed limit of the fan in the low speed active operating state, the fan is unpowered in the inactive operating state and the fan is inoperable at speeds below the modulated speed limit, and wherein an angular velocity of a plurality of blades of the fan is zero for at least a portion of when the fan is in the inactive operating state.

7. The method of claim 6, wherein the fan comprises a direct current motor and a pulse-width modulation circuit, the direct current motor operable to rotate the plurality of blades when the pulse-width modulation circuit powers the direct current motor.

8. The method of claim 6, wherein the fan is inoperable at speeds below the modulated speed limit because the pulse-width modulation circuit does not provide enough torque to rotate the plurality of blades with the direct current motor.

9. The method of claim 8, wherein the modulated speed limit of the fan is about six hundred rotations per minute.

10. The method of claim 6, wherein a total time that the fan is in the low speed active operating state during said step of periodically cycling the fan corresponds to a capacity of the compressor.

11. A packaged terminal air conditioner, comprising:

a casing;

a compressor positioned within the casing, the compressor operable to increase a pressure of a refrigerant;

an interior coil positioned within the casing;

a fan positioned within the casing adjacent the interior coil;

an exterior coil positioned within the casing opposite the interior coil; and a controller in operative communication with the compressor and the fan, the controller configured to activate a compressor of the packaged terminal air conditioner such that refrigerant flows through the interior coil; and while the compressor is active, periodically cycle the fan between a low speed active operating state and an inactive operating state, wherein the fan runs at a modulated speed limit of the fan in the low speed active operating state, and the fan does not urge air through the interior coil in the inactive operating state, wherein a total time that the fan is in the low speed active operating state corresponds to a capacity of the compressor, wherein the fan is inoperable at speeds below the modulated speed limit, and wherein an angular velocity of a plurality of blades of the fan is zero for at least a portion of when the fan is in the inactive operating state.

12. The packaged terminal air conditioner of claim 11, wherein the fan comprises a direct current motor and a pulse-width modulation circuit, the direct current motor operable to rotate the plurality of blades when the pulse-width modulation circuit powers the direct current motor.

13. The packaged terminal air conditioner of claim 12, wherein the fan is inoperable at speeds below the modulated speed limit because the pulse-width modulation circuit does not provide enough torque to rotate the plurality of blades with the direct current motor.

14. The packaged terminal air conditioner of claim 13, wherein the modulated speed limit of the fan is about six hundred rotations per minute.

* * * * *